United States Patent [19]

Grgurich et al.

[11] 4,275,844

[45] Jun. 30, 1981

[54] FUEL INJECTION NOZZLE

[75] Inventors: William A. Grgurich; Albert B. Niles; Kenneth W. Updyke, all of Peoria, Ill.

[73] Assignee: Caterpillar Tractor Co., Peoria, Ill.

[21] Appl. No.: 143,583

[22] PCT Filed: Nov. 30, 1979

[86] PCT No.: PCT/US79/01091

§ 371 Date: Nov. 30, 1979

§ 102(e) Date: Nov. 30, 1979

[51] Int. Cl.[3] ..... F02M 61/18

[52] U.S. Cl. ..... 239/533.3

[58] Field of Search ..... 239/124, 125, 533.3–533.12; 123/32 JV, 139 AN, 139 AT

[56] References Cited

U.S. PATENT DOCUMENTS

| | | | |
|---|---|---|---|
| 2,747,555 | 5/1956 | Brunner | 123/139 AT X |
| 2,927,737 | 3/1960 | Zeuch et al. | 239/533.3 |
| 3,071,153 | 1/1963 | Cornelius | 137/516.29 |
| 3,722,801 | 3/1973 | Chapuis | 239/533.11 |
| 3,777,984 | 12/1973 | Greathouse | 239/533.6 |
| 3,836,080 | 9/1974 | Butterfield et al. | 239/533.4 X |
| 3,980,237 | 9/1976 | Parrish, Jr. | 239/533.3 |
| 4,168,804 | 9/1979 | Hofmann . | |

FOREIGN PATENT DOCUMENTS 402510 5/1980 Switzerland .

*Primary Examiner*—Andres Kashnikow

*Attorney, Agent, or Firm*—Wegner, Stellman, McCord, Wood & Dalton

[57] ABSTRACT

Loss of valve opening pressure (VOP) attributed to wear of contacting portions in fuel injection nozzle valves (22) is limited due to provision of a valve tip (38) having a lower portion (38*a*) which repetitively engages only a lower portion (40*a*) of a valve seat (40). Advantageous wear of the engaging portions increases the seating area but reduces the effective differential area for fuel pressure to act against, thus reducing the need for increased pressure to open or unseat the valve (22). Increased clearance results in less wear between a reciprocating valve (36) and a cooperating guide (34) which also contributes to reduced (VOP) loss during the life of such nozzle valves (22).

12 Claims, 6 Drawing Figures

FUEL INJECTION NOZZLE

DESCRIPTION

1. Technical Field

This invention relates generally to fluid sprinkling, spraying and diffusing and more particularly to fluid pressure responsive discharge modifiers such as fuel injectors.

2. Background Art

In general, fuel injection nozzle valves operate in response to high pressure fuel creating forces acting on differential areas of the valve causing rapid reciprocation of the valve. The rapid reciprocation causes intermittent seating and unseating of a tip of the valve with a valve seat which permits the fuel to be injected into engine cylinders. Under the influence of such high pressure, this seating and unseating results in tip wear known to change the differential areas to the point where valve operating characteristics are undesirably changed. Also, the rapid reciprocation of the valve in a valve alignment guide causes detrimental wear between the valve and guide the add to the undesirable change in operating characteristics.

Parameters which govern the desired operating characteristics of the valve, therefore, change through use of the valve. These parameters include a desired relationship between valve opening pressure (VOP) and valve closing pressure (VCP).

VOP results from high pressure fluid forces intermittently imposed on the valve and is required to cause the valve to lift or unseat and permit fuel injection. Over a period of time, wear at the tip and seat can cause a detrimental loss of VOP (VOP loss).

VCP results from forces acting on the valve and is required to cause the valve to seat and stop fuel injection. Conventional fuel injection nozzle valves become seated between the timing of the intermittently imposed high pressure fluid forces which lift the valve from the seat. Such seating is usually accomplished by a high rate spring matched with specific initial VOP parameters. Conventional fuel injection nozzle valves also have a relatively close fit between the valve and guide to limit leakage of fuel past the guide. Some fuel does leak past the guide and is usually returned to a fuel reservoir. The tight fit creates high friction forces which limit rapid valve closing resulting in poor injection. As the valve and guide wear, friction is reduced and VOP loss occurs due to the reduced friction. The spring then becomes unmatched with the specific initial VOP parameters. In addition, the desired relationship of VOP to VCP gradually deteriorates. Such deterioration results in inefficient fuel injection causing fuel waste, unduly high emissions, and excessive smoke.

The foregoing illustrates limitations of the known prior art. Thus, it is apparent that it would be advantageous to provide an alternative to the prior art. Accordingly, the present invention is directed to overcoming one or more of the limitations as set forth above.

DISCLOSURE OF INVENTION

In one aspect of the present invention, this is accomplished by providing a fuel injection nozzle valve including a housing having a conical seat of a first conical angle and a reciprocative valve member having a conical tip of a second conical angle less than the first conical angle. This provides for engaging only the lower portion of the valve tip at only the lower portion of the valve seat, and effectively reduces limitations of the known prior art. In another aspect of this invention, increased wear reducing clearance is provided between the valve member and a valve guide.

The foregoing and other aspects will become apparent from the following detailed description of the invention when considered in conjunction with the accompanying drawings. It is to be expressly understood, however, that the drawings are not intended as a definition of the invention but are for the purpose of illustration only.

BEST MODE FOR CARRYING OUT THE INVENTION

Figures 1, 2:
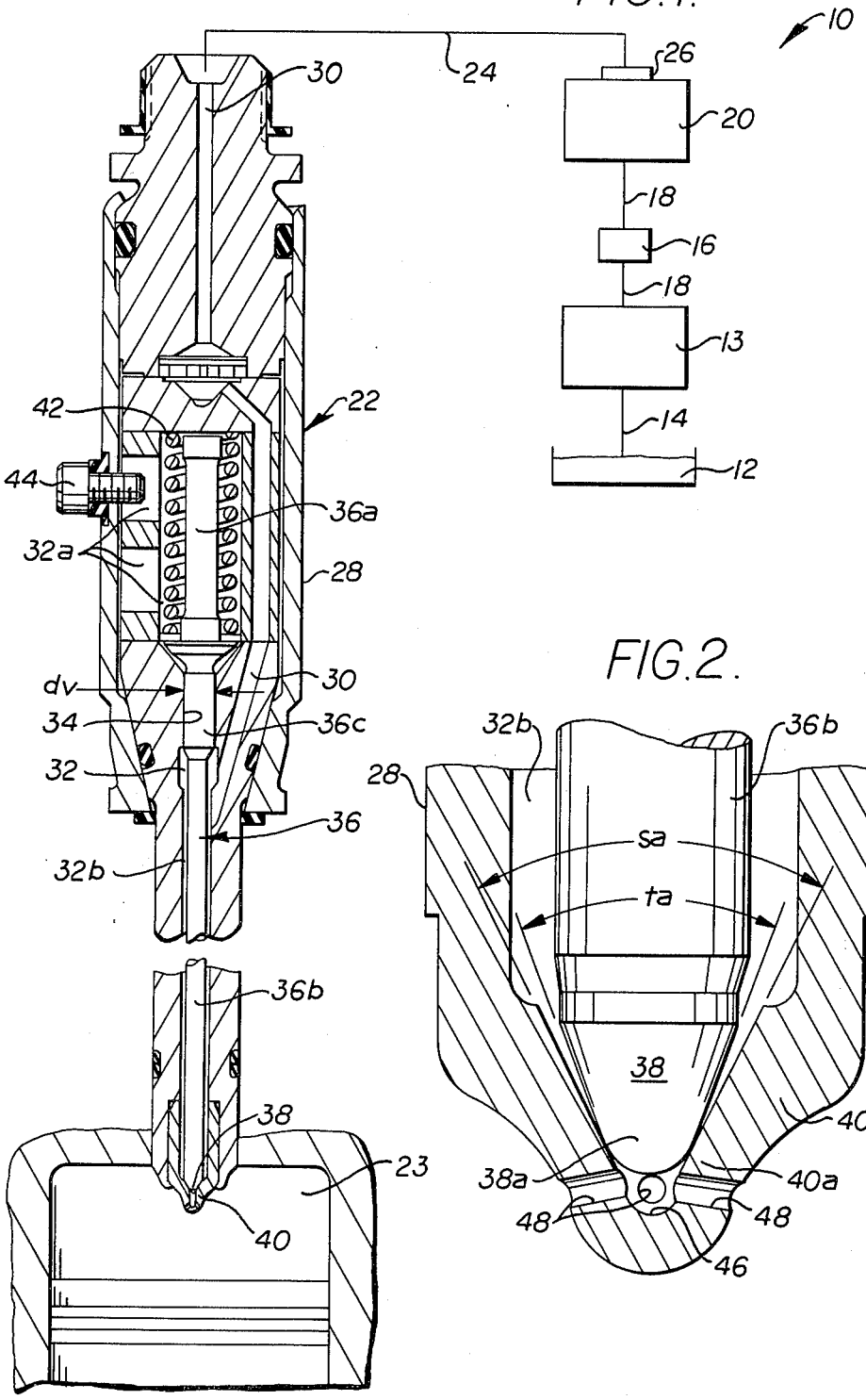
FIG. 1 is a view illustrating a fuel system including an embodiment of the present invention.
FIG. 2 is a view illustrating an enlarged partial section of a nozzle valve tip and seat embodiment of FIG. 1.

In FIG. 1, a fuel system is generally designated 10, and includes a reservoir 12. A well known fuel transfer pump 13 is connected via a conduit 14 for pumping fuel from reservoir 12 at a system pressure of about 30–35 psi. The fuel is then passed through a known filter 16 in conduit 18 to a conventional high pressure fuel injection pump 20 which supplies the fuel at pressures ranging from about 2000 psi to about 15,000 psi and then to a fuel injection nozzle 22 via a conduit 24. It is preferred that a known reverse flow check valve 26 is between high pressure pump 20 and nozzle 22 to check against pressure waves which may oscillate between pump 20 and nozzle 22 as a result of rapidly created high pressure surges of fuel being pumped through nozzle 22 into an associated engine cylinder 23 at a rate of several times per second.

Nozzle 22 comprises a housing 28 having a fuel passage 30 for receiving fuel from pump 20 and for conducting the fuel to a cavity 32 formed in housing 28.

Figure 4:
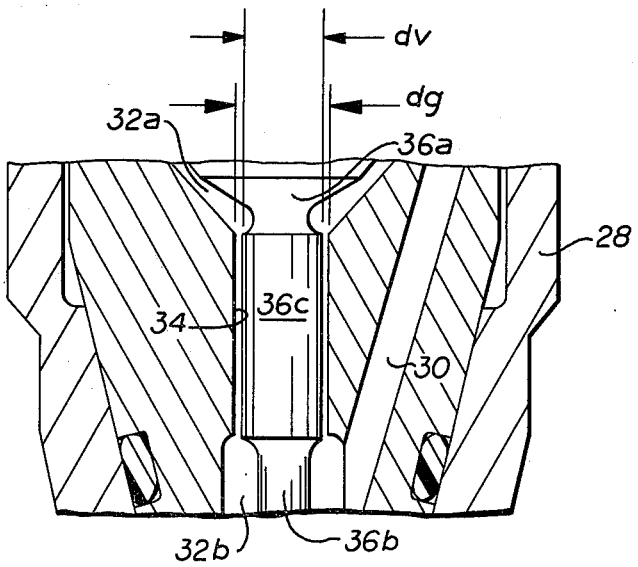
FIG. 4 is a view illustrating another enlarged partial section of the valve and guide embodiment of FIG. 1.

Housing 28 defines an upper cavity portion **32*a* and a lower cavity portion 32*b* and further defines a reduced diameter cylindrical guide 34 separating the upper and lower cavity portions 32*a*,32*b*, respectively. Guide 34 has a diameter designated dg in FIG. 4**.

A valve member 36 is reciprocably disposed in cavity 32. An extended portion **36*a* of valve 36 extends into upper cavity portion 32*a*. Valve 36 includes a lower portion 36*b* having a tip 38 urged into engagement with a valve seat 40 formed in housing 28. Tip 38 is so urged by a resilient means such as a compression spring 42 disposed in upper cavity portion 32*a*. Upper and lower valve portions 36*a*,36*b*, respectively, are separated by an enlarged diameter valve portion 36*c* which reciprocates within guide 34 and has a valve diameter designated dv in FIG. 4**.

The foregoing generally describes a conventional fuel injection nozzle. Clearance between the valve portion 36*c* and guide 34 is generally kept to a minimum. That is, valve portion 36*c* and guide 34 have a relatively tight fit to limit leakage of fuel from lower cavity 32*b* to upper cavity 32*a*. Such tight fit causes the problem of high frictional forces between the valve and guide which limit movement of valve portion 36*c* in guide 34. Such friction causes substantial wear which substantially changes the initial valve and guide diameters so that after prolonged hours of operation, the initial operating characteristics of the nozzle become undesirably changed. Fuel which does leak into upper cavity 32*a* is returned to the fuel reservoir.

The present invention generally includes housing 28 provided with a guide 34 of a first diameter dg separating upper cavity 32*a* from lower cavity 32*b*. Valve 36 is provided with an enlarged diameter portion 36*c* reciprocable in guide 34 and having a second diameter dv, less than the guide diameter dg. The diameters dv,dg, define a clearance sufficient for passing fluid from the lower cavity 32*b* to the upper cavity 32*a* for metering relative fluid pressures in said cavities 32*a*,32*b* to avoid a hydraulic lock of valve 36 in housing 28. Fluid passing through the clearance forms a lubricating fluid film which assists in hydraulically aligning valve portion 36*c* in guide 34. The clearance varies depending on parameters of nozzle 22 relating to the diameter dg and length of guide 34, and the quantity and pressure of fluid volume trapped in upper cavity 32*a*.

Specifically, for example, this invention avoids conventional friction and wear problems by cooperatively forming valve diameter dv for reciprocating within guide diameter dg such that the initial diametral clearance between the valve and guide (guide clearance) is expanded from the conventional tight fit (0.000100 inches to 0.000150 inches) to an initial diametral clearance range of from about 0.000450 inches to about 0.000650 inches. That is, dg minus dv will preferably vary initially from about 0.000450 inches to about 0.000650 inches. Such expanded clearance permits passage or leakage of fuel from lower cavity 32*b* to upper cavity 32*a*. Due to the expanded diametral clearance, friction and thus wear are substantially reduced between guide 34 and valve portion 36*c*. Such leakage provides an advantageous lubricating hydraulic film of fluid in the expanded clearance between guide 34 and valve portion 36*c*. Fuel which leaks into cavity 32*a* is not returned to reservoir 12 since cavity 32*a* represents a trapped volume having no outlet except for a bleed screw 44 which is normally closed but may be selectively opened if desired. There is less wear between guide 34 and valve portion 36*c* as compared to previously known nozzles. Thus, the increased guide clearance of the present invention substantially reduces a change in VCP during the useful life of nozzle 22. Also, increased guide clearance provides an advantageous hydraulic film between guide 34 and valve portion 36*c* which permits valve 36 to self align resulting in a centered seating of tip 38 on seat 40 and reduced impact loads during seating of tip 38 on seat 40. In this example, the diameter dg of guide 34 is about 3.9878 mm, length of guide 34 is about 7.644 mm, the trapped volume quantity is about 1.214 $cm^3$, and the peak trapped volume pressure is about 900 psi.

Figure 5:
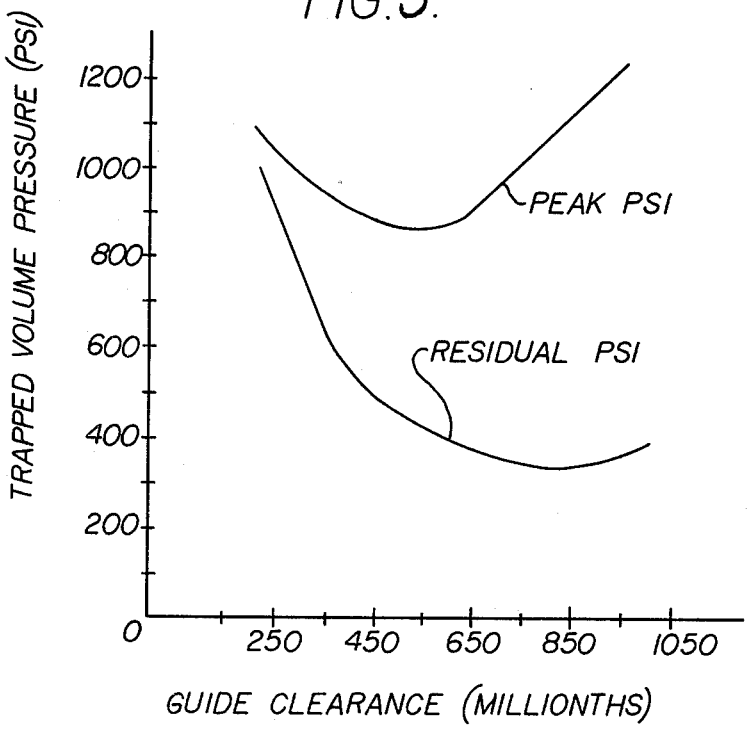
FIG. 5 is a view illustrating a graphic representation of guide clearance to trapped volume pressure relationships of the present invention.

The graph of FIG. 5 illustrates the basis for the preferred guide clearance range. The trapped volume of fuel which leaks into upper cavity portion 32*a* ultimately reaches a peak pressure, that is, the highest pressure the trapped volume of fuel sees during an injection stroke of valve 36. This peak pressure, in addition to spring 42, acts on upper portion 36*a* of valve 36 on closing or seating of tip 38 against seat 40. Residual trapped volume fuel pressure is the average pressure between injections, of the fuel remaining in upper cavity 32*a* after seating of tip 38 against seat 40. From the FIG. 5 graph, it is apparent that the peak pressure curve has a substantially stable portion extending from a guide clearance of about 0.000450 inches to about 0.000650 inches. The portion of the peak pressure curve wherein the guide clearance is greater than 0.000650 inches illustrates that peak pressure rises at a rate sufficient to eventually cause a hydraulic lock of valve 36 in housing 28. That is, if guide clearance is too great the value of the pressures in cavities 32*a*,32*b* will converge and valve 36 will not reciprocate. Thus, the preferred guide clearance range of about 0.000450 to about 0.000650 permits the VCP to substantially stabilize resulting from a combination of forces acting on upper valve portion 36*a* including forces exerted by spring 42 and forces exerted by trapped volume peak pressure in upper cavity 32*a*. These forces act across an area defined by the diameter dv of valve 36 at portion 36*c*. Also, in the preferred guide clearance range, residual pressure is substantially reduced which lowers VOP required to lift valve 36 for the next injection.

Figure 3:
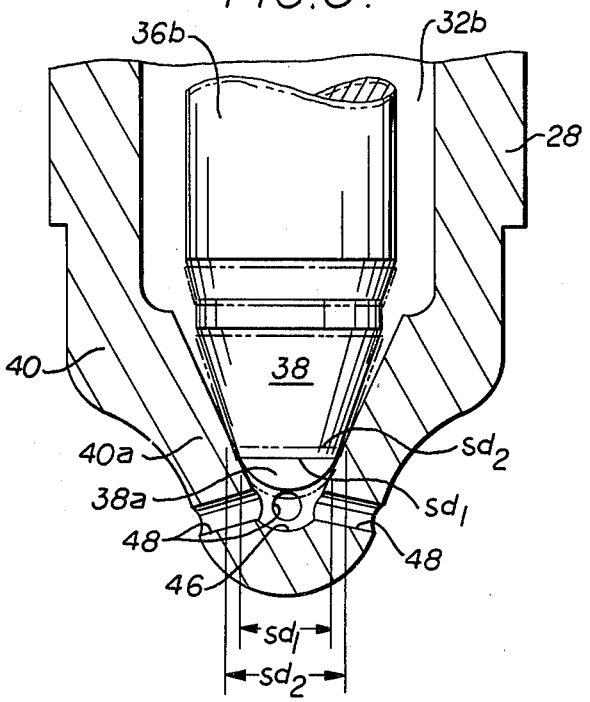
FIG. 3 is a view illustrating another enlarged partial section of the nozzle valve tip and seat embodiment of FIG. 2 further illustrating wear effects of the tip and seat.

The present invention also uses wear advantageously to avoid detrimental VOP loss during the useful life of nozzle 22. This is accomplished by providing seat 40 with preferably a constant conical angle sa and also providing tip 38 with a constant conical angle ta which is less than the angle sa, see FIG. 2. According to this invention it is preferred that angle ta be less than angle sa by a magnitude of from about 2.5 degrees to about 3.5 degrees. In this manner only a lower portion 38*a* of tip 38 contacts only a lower portion 40*a* of seat 40. As a result, tip portion 38*a* and seat portion 40*a* have an interference fit and contact is made at an initial (solid line) diameter $sd_1$, see FIG. 3. Through prolonged use of nozzle 22, numerous intermittent contacts between tip 38 and seat 40 result in wear of both the tip and seat. Due to the preferred interference fit of the constant conical angles sa, ta, contact between tip 38 and seat 40 eventually occurs at a second (dotted line) diameter $sd_2$, greater than $sd_1$. The diameters $sd_1$, $sd_2$, define areas of valve 36 at lower tip portion 38*a*. VOP acts across these areas to open nozzle 22 for injecting fuel into the associated cylinder 23. The area defined by diameter dv of valve 36 at portion 36*c* and the areas defined by the diameters $sd_1$, $sd_2$ of valve 36 at tip portion 38*a*, are the differential areas affected by fuel pressure for causing valve 36 to reciprocate in housing 28 and provide fuel injection. It can be seen, therefore, that with an increase from diameter $sd_1$ to diameter $sd_2$, and with diameter dv and the force of spring 42 remaining substantially constant, the difference between the defined areas will be reduced and the high VOP losses associated with a conventional valve can be significantly reduced, if not avoided entirely.

An advantage of providing contact between lower tip portion 38*a* and lower seat portion 40*a* is a resultant reduction in volume of a sac portion 46. It is well known that a small sac volume 46 is preferred and results in decreasing the emission of hydrocarbons into the atmosphere. Also, a desirable effect of small sac volume and a plurality of small orifices 48 is that some hydraulic damping occurs which aids in cushioning the tip to seat contact.

Figure 6:
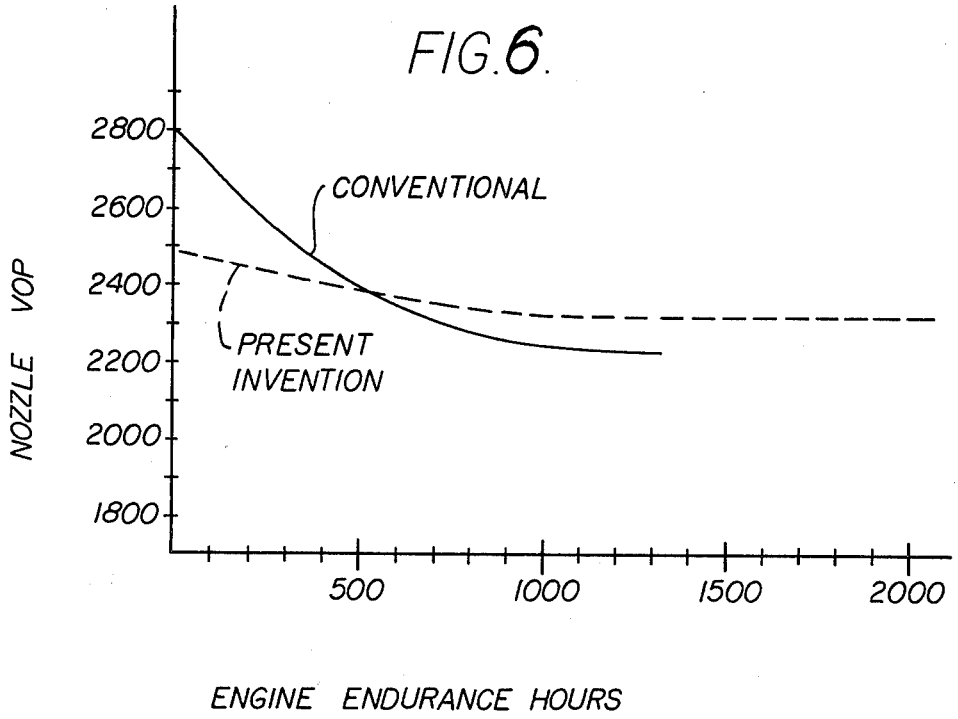
FIG. 6 is a view illustrating a graphic representation of test hours to valve opening pressure (VOP) relationship of the present invention.

An added advantageous feature of this invention is demonstrated by the graph of FIG. 6 which illustrates that conventional initial VOP occurs at about 2800 psi and, during the life of the valve, for example at 1300 engine hours, the VOP has been substantially lowered to about 2230 psi. The present invention, however, significantly reduces initial VOP to about 2500 psi which only slightly lowers to about 2330 psi after 1300 engine hours. Thus, in the given example, the valve of this invention substantially reduces initial VOP and VOP loss when compared to a conventional valve. Lower initial VOP results in lower stress in the nozzle which reduces wear and deterioration of the fuel injection apparatus and system.

Industrial Applicability

With the parts assembled as set forth above high pressure fuel enters cavity 32 and flows to upper portion 32*a* and lower portion 32*b* of cavity 32. Pressure builds at a greater rate in lower portion 32*b* to about 2500 psi to eventually lift tip 38 from seat 40 and cause fuel to be injected into cylinder 23. Increased clearance between guide 34 and valve portion 36*c* permits eventual stabilization of peak pressure to about 900 psi in upper cavity portion 32*a*.

Prolonged use of nozzle 32 causes an area of tip 38 to seat 40 contact to increase as defined by an initial diameter $sd_1$ to an eventual diameter of $sd_2$, greater than $sd_1$. Diameter dv of valve portion 36*c* remains substantially constant due to reduced wear between guide 34 and valve portion 36*c*. As a result, the difference between the areas defined by diameters dv and $sd_2$ is reduced and substantial VOP loss is avoided.

The foregoing has described a fuel injection nozzle which reduces detrimental wear between the valve and guide and advantageously utilizes wear between the tip and seat to reduce VOP loss during the life of the nozzle. It can be appreciated by those skilled in the art that the preferred guide clearance range and tip to seat angular relationship can be determined for various size nozzle valves according to the teachings of this invention.

It is anticipated that aspects of the present invention, other than those specifically defined in the appended claims, can be obtained from the foregoing description and the drawings.

We claim:

1. A fuel injection nozzle (22) comprising:

a housing (28), said housing (28) having a valve guide (34) of a first diameter (dg) separating a closed upper fluid cavity (32*a*) from a lower fluid cavity (32*b*), and having a conical seat (40) of a first constant conical angle (sa), said seat (40) including a lower portion (40*a*);

means for engaging only said lower portion (40*a*) of said seat (40), said means being a valve (36) reciprocable in said housing (28), said valve (36) having a conical tip (38) of a second constant conical angle (ta) less than said first angle (sa), said tip (38) including a lower portion (38*a*) having an interference fit with said lower seat portion (40*a*), said valve (36) having an enlarged diameter portion (36*c*) reciprocable in said guide (34), said enlarged diameter portion (36*c*) being of a second diameter (dv) less than said first guide diameter (dg), said diameters (dv,dg) defining a clearance sufficient for metering an amount of fluid between said upper (32*a*) and lower (32*b*) cavities for maintaining relative fluid pressures in said cavities (32*a*,32*b*) to avoid a hydraulic lock of said valve (36) in said housing (28).

2. A fuel injection nozzle (22) comprising:

a housing (28), said housing (28) having a conical seat (40) of a first constant conical angle (sa), said seat (40) including a lower portion (40*a*);

means for engaging only said lower portion (40*a*) of said seat (40), said means being a valve (36) reciprocable in said housing (28), said valve (36) having a conical tip (38) of a second constant conical angle (ta) less than said first angle (sa), said tip (38) having a lower portion (38*a*) and being of a construction sufficient to cause only said lower tip portion (38*a*) to contact only said lower seat portion (40*a*) to define a sac volume (46) in response to said valve (36) reciprocating in said housing (28), said sac volume (46) being sufficiently small to minimize emission of hydrocarbons.

3. A fuel injection nozzle (22) comprising:

a housing (28), said housing having a guide (34) and a conical seat (40) of a first conical angle (sa), said seat including a lower portion (40*a*);

means for engaging only said lower portion (40*a*) of said seat (40), said means being a valve (36) reciprocable in said housing (28), said valve (36) having an extended portion (36*a*) extending through said guide (34) defining a diametral clearance between said valve (36) and guide (34), said clearance being from about 0.000450 inches to about 0.000650 inches, said valve (36) having a conical tip (38) of a second constant conical angle (ta) less than said first angle (sa), said tip (38) having a lower portion (38*a*) and being of a construction sufficient to cause only said lower tip portion (38*a*) to contact only said lower seat portion (40*a*) in response to said valve (36) reciprocating in said housing (28), said second angle (ta) is less than said first angle (sa) by the magnitude of from about 2.5 degrees to about 3.5 degrees.

4. A fuel injection nozzle (22) comprising:

a housing (28), said housing (28) having a conical seat (40) of a first constant conical angle (sa), said seat (40) including a lower portion (40*a*);

means for engaging only said lower portion (40*a*) of said seat (40), said means being a valve (36) reciprocable in said housing (28), said valve (36) having a conical tip (38) of a second constant conical angle (ta) less than said first angle (sa), said tip (38) having a lower portion (38*a*), said lower tip portion (38*a*) having an interference fit with said lower seat portion (40*a*);

a guide (34) in said housing (28); and said valve (36) having an extended portion (36*a*) extending through said guide (34) defining a diametral clearance between said valve (36) and guide (40), said clearance being from about 0.000450 inches to about 0.000650 inches.

5. The nozzle (22) of claim 4 wherein said second angle (ta) is less than said first angle (sa) by the magnitude of from about 2.5 degrees to about 3.5 degrees.

6. A fuel injection nozzle (22) comprising:

a housing (28), said housing (28) having a conical seat (40) of a first conical angle (sa), said seat (40) including a lower portion (40*a*);

a guide (34) in said housing (28);

a reciprocable valve (36) in said housing (28), said valve (36) having a conical tip (38) of a second constant conical angle (ta) less than said first angle (sa), said tip (38) having a lower portion (38*a*), said lower tip portion (38*a*) having an interference fit with said lower seat portion (40*a*);

an extended portion (36*a*) of said valve (36) extending through said guide (34) defining a diametral clearance with said guide (34) of from about 0.000450 inches to about 0.000650 inches; and said second angle (ta) is less than said first angle (sa) by the magnitude of from about 2.5 degrees to about 3.5 degrees.

7. A fuel system (10) comprising:

a fuel reservoir (12);

a fuel transfer pump (13) connected for pumping fuel from said reservoir (12);

a high pressure fuel pump (20) connected for pumping and greatly pressurizing said fuel from said fuel transfer pump (13);

a nozzle (22) connected to receive said pressurized fuel from said high pressure fuel pump (20), said nozzle (22) including a housing (28), said housing (28) having a conical seat (40) of a first constant conical angle (sa), said seat (40) including a lower portion (40*a*);

means for engaging only said lower portion (40*a*) of said seat (40), said means being a valve (36) reciprocable in said housing (28), said valve (36) having a conical tip (38) of a second constant conical angle (ta) less than said first angle (sa), said tip (38) having a lower portion (38*a*) and having an interference fit with said lower seat portion (40*a*);

said second angle (ta) is less than said first angle (sa) by the magnitude of from about 2.5 degrees to about 3.5 degrees;

a guide (34) in said housing (28);

said valve (36) having a portion (36*a*) extending through said guide (34) defining a diametral clearance between said valve (36) and guide (34), said clearance being from about 0.000450 inches to about 0.000650 inches.

8. The system (10) of claim 7 including:

a fuel filter (16) connected between said fuel transfer pump (13) and said high pressure pump (20).

9. The system (10) of claim 8 including:

a reverse flow check valve (26) connected between said high pressure pump (20) and said nozzle (22).

10. In a fuel injection nozzle (22) of the type having a housing (28) including a conical seat (40) of a first constant conical angle (sa) and a valve (36) reciprocable in said housing (28), said valve (36) having a conical tip (38) of a second constant conical angle (ta), a guide (34) in said housing (28) and an extended portion (36*a*) of said valve (36) extending through said guide (34), the improvement comprising:

said second angle (ta) is less than said first angle (sa) by the magnitude of from about 2.5 degrees to about 3.5 degrees; and a diametral clearance between said valve (36) and said guide (34) of from about 0.000450 inches to about 0.000650 inches.

11. A fuel injection nozzle comprising:

a housing (28) for receiving fuel and terminating in at least one fuel outlet (48) adapted to be disposed in the combustion space (23) of an internal combustion engine;

a valve seat (40) in said housing (28) in close proximity to said outlet (48);

a valve (36) reciprocally movable in said housing (28) between positions spaced from said valve seat (40) to allow the flow of fuel from said housing (28) through said outlet (48) and in sealing contact with said valve seat (40);

means (34) within said housing (28) for guiding said valve (36) during reciprocal movement between said positions; and means defining a clearance between said valve (36) and said guide means (34) including a first diameter (dg) section on said guide means (34) and a second diameter (dv) section (36*c*) on said valve (36), said first and second diameters (dg, dv) differing by an amount sufficient to allow passage of a sufficiently large quantity of fuel through said clearance to hydraulically align said valve (36) with said valve seat (40) and provide lubrication of said valve (36) within said guide means (34) to thereby minimize frictional wear between said valve (36) and said guide means (34) and the limiting of valve movement between said positions while assuring proper alignment of said valve (36) with said valve seat (40).

12. The fuel injection nozzle of claim 11, wherein said first and second diameters differ by an amount considerably greater than 0.00015 inches.

* * * * *

Disclaimer

4,275,844.—*William A. Grgurich, Albert B. Niles* and *Kenneth W. Updyke,* Peoria, Ill. FUEL INJECTION NOZZLE. Patent dated June 30, 1981. Disclaimer filed Dec. 1, 1983, by the assignee, *Caterpillar Tractor Co.*

Hereby enters this disclaimer to claims 1, 11 and 12 of said patent.

[*Official Gazette January 10, 1984.*]